United States Patent [19]

Harris

[11] Patent Number: 4,741,440

[45] **Date of Patent: * May 3, 1988**

[54] PACKAGE FOR HORTICULTURAL ITEMS

[76] Inventor: Charles C. Harris, 1022 Fox Chase Industrial Dr., Arnold, Mo. 63010

[ * ] Notice: The portion of the term of this patent subsequent to Nov. 11, 2003 has been disclaimed.

[21] Appl. No.: 928,981

[22] Filed: Nov. 10, 1986

Related U.S. Application Data

[63] Continuation of Ser. No. 670,679, Nov. 13, 1984.

[51] Int. Cl.[4] ..... B65D 85/50

[52] U.S. Cl. ..... 206/423; 47/84; 206/514

[58] Field of Search ..... 206/423, 518, 514; 47/41 R, 84; 229/164

[56] References Cited

U.S. PATENT DOCUMENTS

| | | | |
|---|---|---|---|
| 1,167,409 | 1/1916 | Joslin | 229/114 |
| 1,183,454 | 5/1916 | Hayashi | 53/241 |
| 2,033,526 | 3/1936 | Kinkenon | 206/45.14 |
| 2,150,453 | 3/1939 | Mulford et al. | 206/423 |
| 2,575,919 | 11/1951 | Kautzmann | 206/509 |
| 2,675,166 | 4/1954 | Main | 229/164 |
| 2,774,187 | 12/1956 | Smithers | 206/423 |
| 2,835,430 | 5/1958 | Frankenstein | 229/114 |
| 2,917,219 | 12/1959 | Schimel | 229/23 R |
| 3,053,010 | 9/1962 | De Shazor, Jr. | 206/423 |
| 3,207,414 | 9/1965 | Locke et al. | 229/125 |
| 3,623,650 | 11/1971 | Watts | 229/DIG. 11 |
| 4,078,658 | 3/1978 | Neiser | 206/423 |
| 4,245,773 | 1/1981 | Stollberg . | |

FOREIGN PATENT DOCUMENTS

| | | | |
|---|---|---|---|
| 2342606 | 3/1974 | Fed. Rep. of Germany | 206/518 |
| 2036163 | 12/1970 | France | 206/423 |
| 2309427 | 11/1976 | France | 206/423 |
| 0231167 | 3/1944 | Switzerland | 206/423 |
| 0891078 | 3/1962 | United Kingdom | 47/84 |

*Primary Examiner*—Jimmy G. Foster

*Attorney, Agent, or Firm*—Cohn, Powell & Hind

[57] ABSTRACT

A package for horticultural items with a receptacle includes a container having a base portion for supporting the receptacle and side portions connected to and extending upwardly from the base portion about the receptacle. A flexible sleeve engages the container side portions to support the container and enclose the horticultural item. The sleeves are supported on a pedestal having flexible straps for spreading the sleeves and allowing removal of a sleeve for packaging the horticultural item.

6 Claims, 3 Drawing Sheets

PACKAGE FOR HORTICULTURAL ITEMS

This is a continuation of copending application(s) Ser. No. 670,679 filed on Nov. 13, 1984.

BACKGROUND OF THE INVENTION

This invention relates to packaging horticultural items in general, and in particular to packaging horticultural items with a receptacle which utilizes a container means, and a sleeve that engages the container for wrapping the horticultural items and receptacle.

The use of a sleeve for wrapping a potted plant is disclosed in U.S. Pat. No. 1,183,458. In this patent, the use of a sleeve which directly engages the plant pot is disclosed. While enclosing the plant, the sleeve offers little mechanical protection for the pot or thermal insulation of the pot. Current practice for wrapping floral arrangements and plants in odd size receptacles such as bud vases, cruets or brandy snifters is to place such items in boxes and then wrap the box and items with sheet material, the sheet material being either taped or stapled to the box. This procedure is both slow and awkward.

SUMMARY OF THE INVENTION

The present advantageous package for horticultural items with a receptacle includes a container for receiving the receptacle, and a flexible sleeve engageable with the container to support the container. The package can be utilized with potted plants, floral arrangements and various different types of receptacles for providing a convenient, simple and expedient package for horticultural items. Furthermore, this package for horticultural items can be utilized with potted plants providing thermal and shock insulation between the pot and any surface which the package engages.

The package for horticultural items with a receptacle includes a container having a base portion for supporting the receptacle, and side portions connected to and extending upwardly from the base portion about the receptacle. A flexible sleeve having a relatively larger upper opening and a relatively smaller lower opening engages the container side portion to support the container. In the preferred embodiment of the invention, the sleeve is conically shaped.

In one aspect of the invention, a pair of opposed side portions extend upwardly and outwardly from the base portion. In another aspect of the invention, a pair of opposed side portions extend substantially vertically upwardly of the base portion. The side portions include upper margins defining an upper container opening for receiving the receptacle.

In yet another aspect of the invention, the vertical side portions include opposed side notches for providing access to the receptacle within the container.

In another aspect of the invention, a modified container includes four upwardly and outwardly tapered side portions. In one aspect of the invention, two opposed side portions include opposed notches.

In still another aspect of the invention, the container includes an upper-wall having an opening for receiving the receptacle. The upper wall has a resilient portion defining the opening for laterally engaging and supporting the receptacle. The upper resilient portion is expandable for permitting insertion and withdrawal of the receptacle into and from the container. A horticultural item and receptacle disposed within the container can be supported by a pedestal. Further, the pedestal supports and retains a supply of flexible sleeves, and provides means for applying a sleeve to the container.

In one aspect of the invention, the sleeve-supporting pedestal includes a base, a support member having an upper end and a lower end, with the support member being connected to the base at its lower end. A platform is connected to the support member upper end. Flexible means are located between the base and the platform for spreading the sleeves.

In one aspect of the invention, the flexible means includes flexible straps connected to the support member. The straps include opposed ends connected to the support member, the straps being bowed laterally outwardly of the support member.

In another aspect of the invention, the support member is a plastic tube, and the straps are plastic and are riveted to the tube. The straps resilient flex for allowing removal of the sleeves from the pedestal.

In still another aspect of the invention, the container includes a substantially rectangular bottom panel having side margins. Opposed side panels, each include a side portion providing a container sidewall marginally connected to the bottom panel, and side flaps connected to opposite sides of the side panel. The side flaps form portions of opposed container sidewalls adjacent to the container sidewall provided by said side portions.

In one aspect of the invention, the side flaps include ear portions, and locking means connected to the bottom panel engaging the side flap ear portions for supporting and retaining the side flaps and side portions.

In another aspect of the invention, the locking means includes opposed marginal slots in the bottom panel adjacent to the side flap ear portions and side lock flaps marginally connected to the bottom panel, the side lock flaps having lips engageable with the bottom panel slots for retaining the side flap ear portions. The side lock flaps fold about the side flap ear portions.

In yet another aspect of the invention, a top flap is marginally connected to one of the side portion, and includes a tongue. The other side portion includes a marginally connected shoulder portion having a slot. The top flap tongue is engageable with the shoulder portion slot.

In still another aspect of the invention, the top flap portions are marginally connected to each of the side portions. The top flap portions include opposed side shoulders having marginal slots. Side flaps include top tabs engageable with the side shoulder marginal slots for supporting the top flap portions.

In another aspect of the invention, the top flap includes a center opening with a plurality of radial slits about the center opening for providing flexible fingers.

DESCRIPTION OF THE PREFERRED EMBODIMENT

Figure 1:
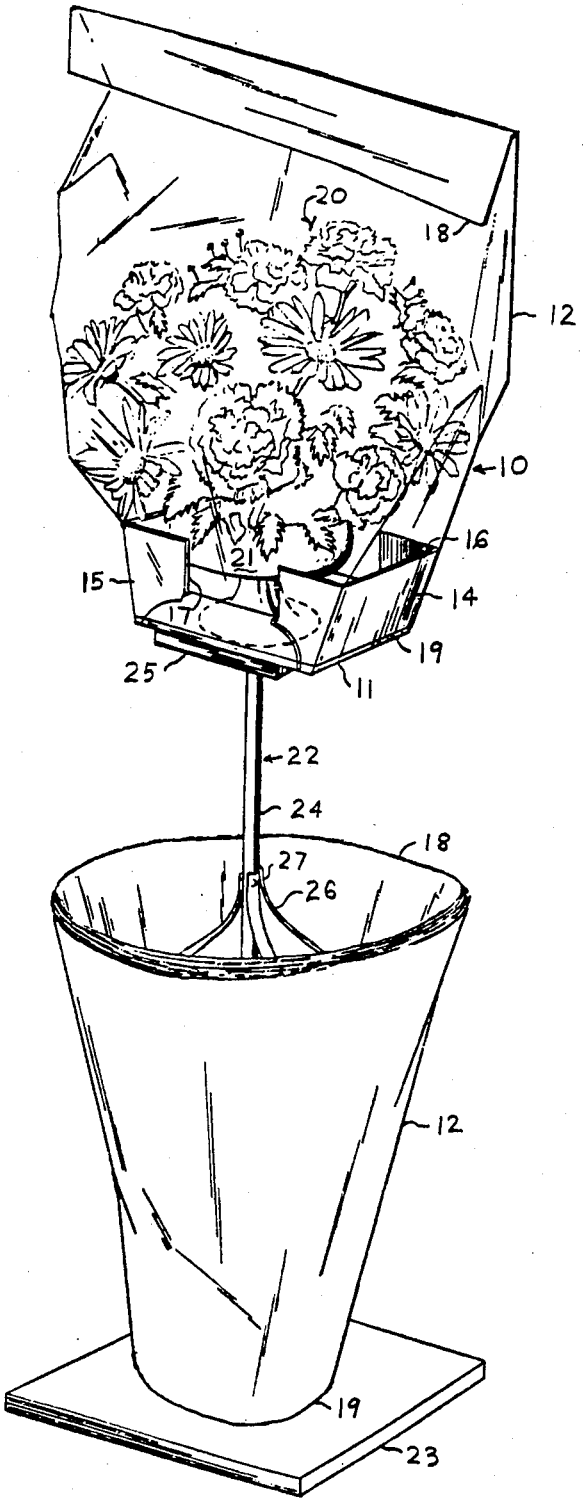
FIG. 1 is a perspective view of the package for horticultural items, and the sleeve-supporting pedestal.

Referring now by characters of reference to the drawings, and first to FIG. 1, it will be seen that the package for horticultural items with a receptacle indicated generally by 10, includes a container 11 constituting a container means, and a flexible sleeve 12.

Figure 3:
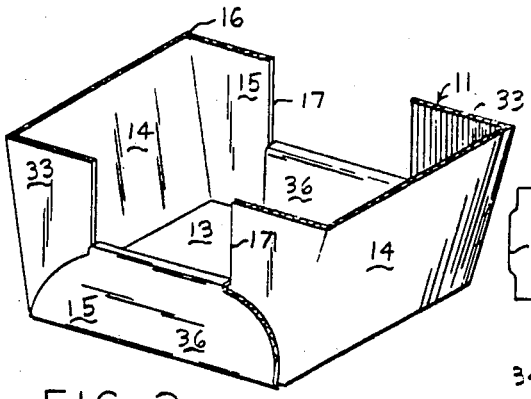
FIG. 3 is a perspective view of a container.

As will be more clearly seen in FIG. 3, the container 11 includes a base portion 13. A first pair of opposed side portions 14 extend upwardly and outwardly from the base portion 13. A second pair of opposed side portions 15 extend substantially vertically upwardly from the base portion 13. As shown the base 13 has a rectangular polygonal shape. The side portions 14 and 15 include upper margins defining an upper container opening 16. The vertical side portions 15 include opposed side notches 17.

Referring again to FIG. 1, it will be seen that a floral arrangement 20 in a receptacle 21 is received by the container 11, with the base portion 13 supporting the receptacle 21. The notches 17 provide access to the receptacle 21 in the container 11.

Figure 2:
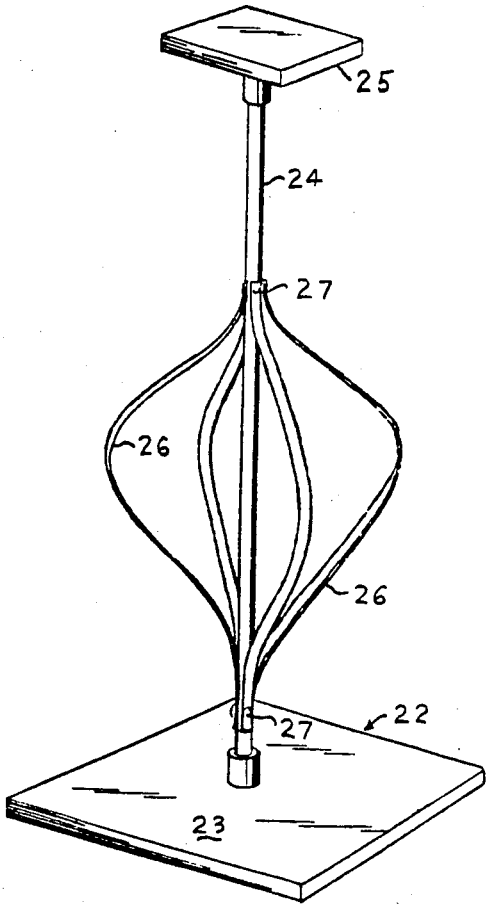
FIG. 2 is a perspective view of the sleeve-supporting pedestal.

The container 11, as shown in FIG. 1, is supported by a sleeve-supporting pedestal 22 which is more clearly seen in FIG. 2. The pedestal 22 includes a base 23, a support member 24, which is a plastic tube, having its lower end connected to the base 23. A platform 25 is connected to the upper end of the support member 24. Located between the base 23 and platform 25 are flexible straps 26, constituting flexible means. The flexible straps 26 are utilized for spreading the sleeves 12 as shown in FIG. 1. The flexible straps 26 include opposed ends connected to the support member 24 as by rivets 27. The flexible straps 26 bow laterally outwardly of the support member 24. The straps 26 resiliently flex for allowing removal of the sleeves 12 from the pedestal 22.

The sleeves 12 are preferably conically shaped with each having a substantially larger top opening 18 and a substantially smaller bottom opening 19. The sleeves 12 are constructed of flexible sheet material such as paper or plastic material. Polyethelene or other plastic materials are particularly advantageous as they allow viewing of the contents of the package 10 through the sleeve 12.

Figure 4:
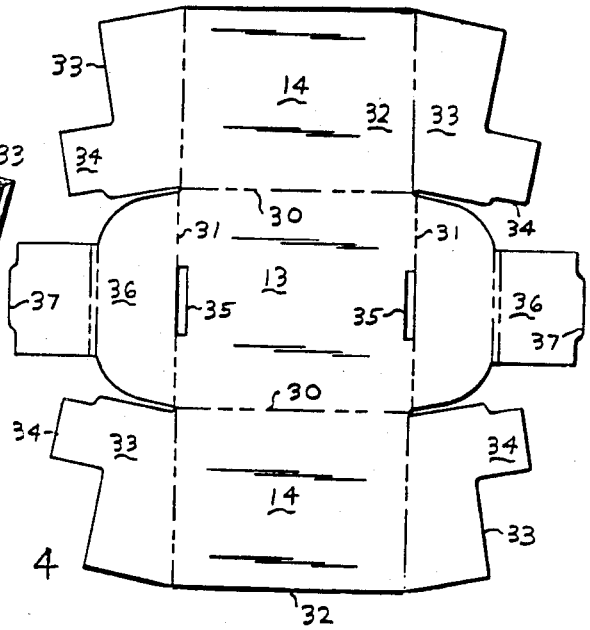
FIG. 4 is a top plan view of the unassembled container of FIG. 3.

Referring now to FIGS. 3 and 4, it will be seen that the container 11 can be constructed of sheet material such as cardboard or corrigated paper. The base portion 13 provides substantially rectangular bottom panel having opposed margins 30 and opposed margins 31. Opposed side panels 32 include the side portions 14 which are marginally connected to the base portion 13 at the margin 30. Side flaps 33 are connected to opposite side margins of the side portion 14. The side flaps 33 form portions of the opposed container sidewalls adjacent to the container sidewalls provided by the side panels 32. The side flaps 33 each include ear portions 34. The base portion 13 includes opposed slots 35 at the margins 31 adjacent to the ear portions 34. Side lock flaps 36 are marginally connected to the base portion 13 at the margins 31. The side flaps 36 fold about the side flap ear portions 34 with lips 37 engaging the slots 35 for providing locking means for engaging the side flap ear portions 34, and supporting and retaining the side flaps 33 and side portions 14.

Figure 5:
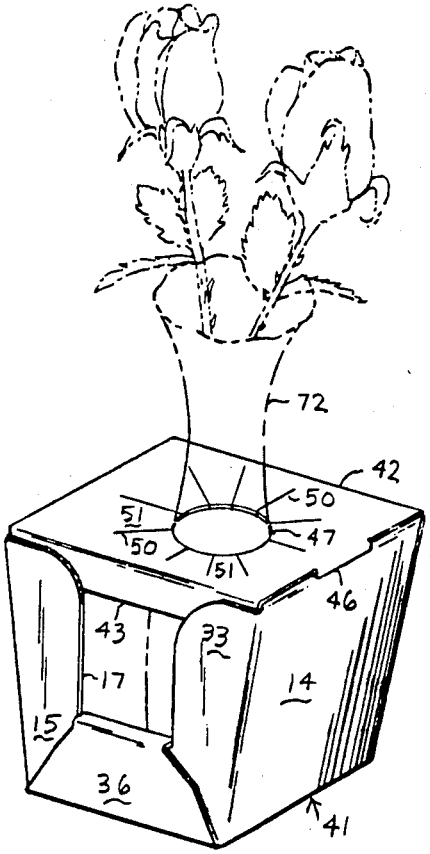
FIG. 5 is a perspective view of a modified container.
Figure 6:
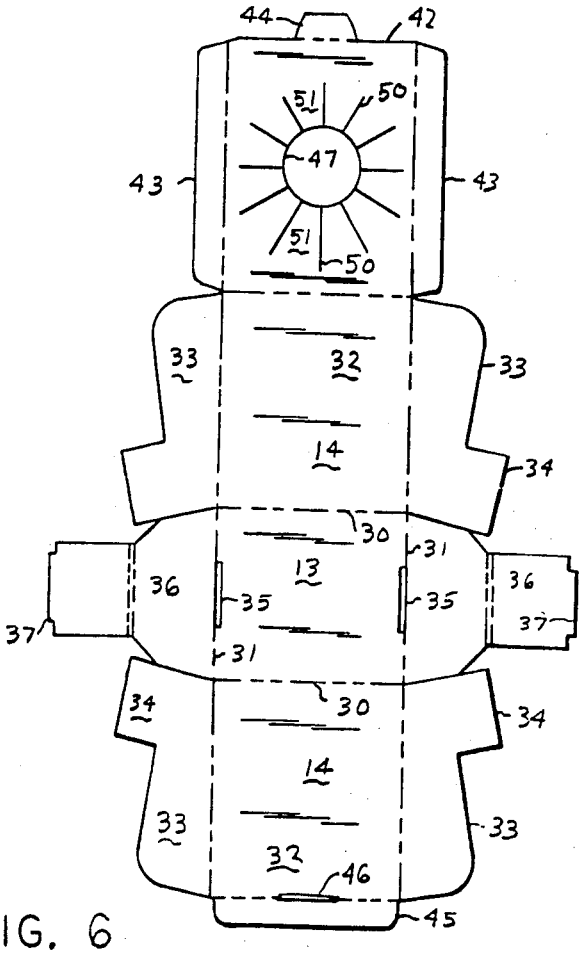
FIG. 6 is a top plan view of the unassembled container of FIG. 5.

Referring now to FIGS. 5 and 6, a modified container 41 is disclosed. The container 41 is similar in construction to the container 11 and similar parts have been given the same reference characters. A top flap 42 providing an upper wall, is marginally connected to the upper margin of one of the side portions 14. The top flap 42 includes opposed side shoulders 43, and a tongue 44 connected to the top wall margin opposite to the margin connected to the side portion 14. The other side panel 33 includes a shoulder portion 45 connected at its upper margin. A slot 46 is provided at said margin for receiving the tongue 44.

The top flap 42 includes a center opening 47 having a plurality of radial slits 50. The radial slits 50 provide a plurality of flexible fingers 51 in the flap 42.

Figure 7:
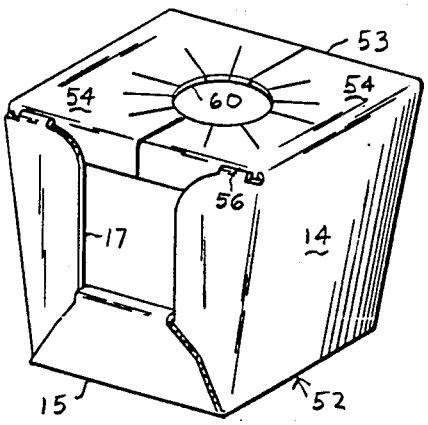
FIG. 7 is a perspective view of still another container.
Figure 8:
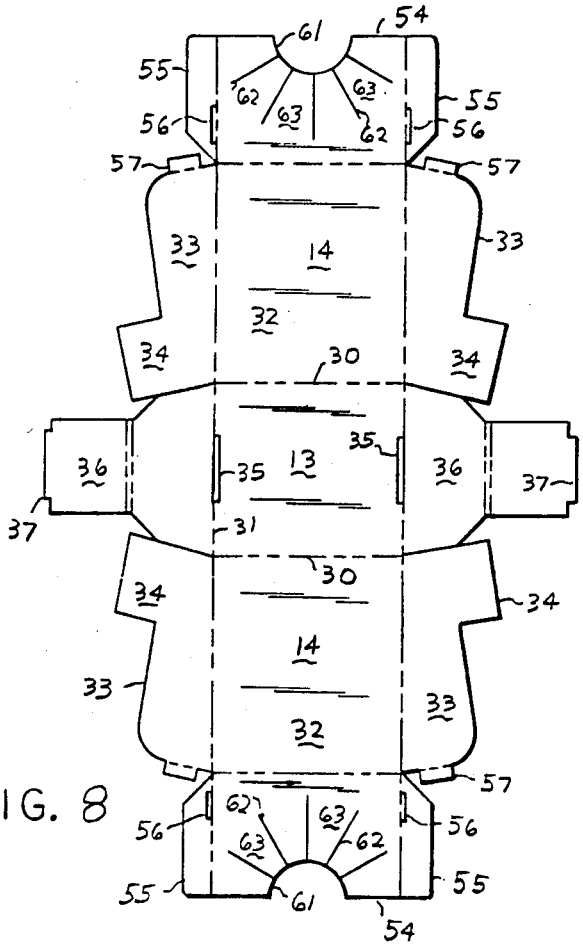
FIG. 8 is a top plan view of the unassembled container of FIG. 7.

Referring now to FIGS. 7 and 8, an additional modified container 52 is shown in which parts that are similar to the containers 11 and 41 are indicated by the same characters of reference. The container 52 includes a top wall 53 provided by top flap portions 54.

Each top flap portion 54 is connected to an upper margin of a side flaps 32. The top flap portions 54 each include opposed side shoulder portions 55 having marginal slots 56. The slots 56 receive top tabs 57 which are connected to the upper margins of the side flaps 33.

A center opening 60 (FIG. 7) is provided, when the top flap portions 54 are brought together, by the semi circular margin portions 61 of each top flap portion 54. A plurality of radial slits 62 extend from each semi-circular margin portion 61 and provide flexible fingers 63 in each of the top flap portions 54.

Figure 9:
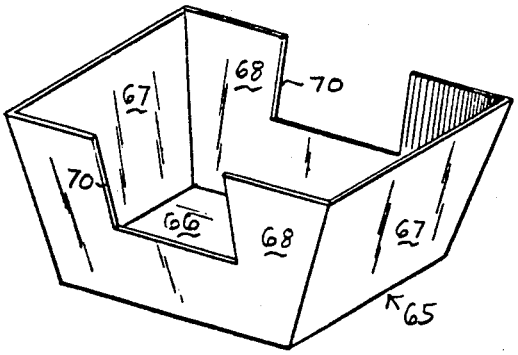
FIG. 9 is a perspective view of yet another container.

Another container 65 is disclosed in FIG. 9. The container 65 has a base portion 66 with four upwardly and outwardly tapered sidewall portions including opposed wall portions 67, and opposed wall portions 68 interconnecting the wall portions 67. Opposed side marginal notches 70 are included in the wall portions 68. The container 65 can be constructed of cardboard material, but in the preferred embodiment is of molded plastic material.

It is thought that the structural features and functional advantages of the package for horticultural items have become fully apparent from the foregoing description of parts, but for completeness of disclosure, a brief description of the operation and use of the package will be given.

When it is desired to package a horticultural item, an appropriate container such as the containers 11, 41, 52 or 65 is placed on the pedestal 24. The containers 11, 41 and 52 are normally stored flat to conserve storage and shipping space.

It will be seen that these containers are extremely efficient in the use of cardboard when they are manufactured. As seen in FIGS. 4, 6 and 8, the side lock flaps 36 do not extend substantially beyond the side flaps 33 of the side panels 32. '

Assembly of the containers 11, 41 and 52 is substantially the same. The side panels 32 are folded upwardly from the base portion 13 at the margins 30, while the side flaps 33 are folded inwardly on the side portions 14. The side lock flaps 36 are then folded upwardly from the base portion 13 at the margins 31, and are folded down about the ear portions 34, with the lips 37 engaging the slots 35. This completes assembly of the container 11.

For the container 41 of FIG. 6, the side shoulders 43 of the top flap 42 are folded inwardly, as is the tongue 44. The top wall 42 is then folded down, with the tongue 44 being received by the slot 46, and with the side-shoulders 43 being received within the side flap 42.

For the container 52 of FIG. 8, the side shoulder portions 55 of the top flap portions 54 are folded inwardly, and the top flap portions 54 are then folded downwardly with the tabs 57 inserted in the slots 56.

It will be understood that the containers 41 and 52 are particularly useful for receiving and supporting bud bases, cruets, brandy snifters and the like, as for example the bud base 72 shown in FIG. 5. The containers 11 and 65 ar particularly suited to receiving floral arrangements such as that shown in FIG. 1, or potted plants and other large horticultural items. Horticultural items which can utilize this package 10 include both cut and uncut flowers and plants, and dried and plastic flowers and plants.

When packaging the horticultural item, the item with its receptacle, such as bud vase 72, is placed in a container, such as a container 11 shown in FIG. 1. A sleeve 12 is drawn up about the container 11, with the sleeve 12 engaging the side portions 14 and 15 of the container 11 adjacent to the lower opening 19 of the sleeve 12. In withdrawing a sleeve 12 from the pedestal 22, an inner sleeve 12 is manually drawn upwardly. The straps 26 resiliently flex to allow removal of the smaller diameter lower opening 19 over and from the bowed straps 26. When the sleeve 12 has been placed over the container 11 and floral arrangegent 20, the upper end 18 of the sleeve 12 can be folded over and stapled or taped shut.

The containers 41, 52 and 65 are utilized in a similar manner. These containers 41, 52 and 65 are placed on a pedestal 22 and the particular horticultural item and its receptacle to be wrapped is then placed in the container and an appropriate sleeve 12 is drawn up about the container and closed. If desired, the containers 11, 41, 52 and 65 can be used without a sleeve 12 by wrapping them with sheet material in a conventional manner.

The containers 11, 41, 52 and 65 provide thermal insulation between the receptacle 21 and any surfaces on which the container is placed. Some mechanical shock protection is also provided to the receptacle 21 should the package be bumped or knocked during transportation.

To remove the floral arrangement 20 from the package 10, the sleeve 12 can be removed as by tearing, and the receptacle 21 can be grasped through the notches 17 for removal from the container 11.

The bud vase 72 can be removed from the container 41 by pulling the vase vertically from the container 41, the fingers 51 flexing to allow the vase 72 to pass through the opening 47.

I claim as my invention:

1. A package for horticultural items with a receptacle comprising:

(a) a molded plastic container means including:

1. a polygonal shaped base portion for supporting the receptacle, and
2. a plurality of side portions connected to and extending upwardly from the base portion about the receptacle the side portions including a first pair of opposed side portions extending upwardly and outwardly from the base portion, and (b) a tapered flexible sleeve of foldable plastic sheet material having a relatively larger upper opening and a relatively smaller lower opening, the sleeve being initially formable into a generally conical configuration to receive the different shaped container and being generally conformable to and engageable with the container side portions to support the container means.

2. A package as defined in claim 1, in which:

(c) the base portion is rectangularly shaped, and the side portions include a second pair of upwardly and outwardly extending opposed side portions.

3. A package as defined in claim 1, in which:

(c) at least one pair of opposed side portions include opposed side notches for providing access to the receptacle in the container means.

4. A package for horticultural items with a receptacle comprising:

(a) an erectable container means including:

1. a polygonal shaped base portion for supporting the receptacle, and
2. a plurality of side portions connected to and extending upwardly from the base portion about the receptacle the side portions including a first pair of opposed side portions extending upwardly from the base portion, and (b) a tapered flexible sleeve having a relatively larger upper opening and a relatively smaller lower opening, the sleeve engageable with the container side portions to support the container means.

5. A package as defined in claim 4, in which:

(c) the base portion is rectangularly shaped and the side portions include upper margins defining a rectangular upper opening, and (d) the flexible sleeve is generally conical but conformable to the shape of the container, the container upper opening being larger than the sleeve lower opening so that the flexible sleeve can grip and hold the container.

6. A package for horticultural items with a receptacle comprising:

(a) an erectable container means including:

1. a polygonal shaped base portion for supporting the receptacle, and
2. a plurality of side portions connected to and extending upwardly from the base portion about the receptacle the side portions including a first pair of opposed side portions extending upwardly from the base portion, and (b) a tapered flexible sleeve of foldable plastic sheet material having a relatively larger upper opening and a relatively smaller lower opening, the sleeve being initially formable into a generally conical configuration to receive the different shaped container and being generally conformable to and engageable with the container side portion to support the container means.

* * * * *